US005290037A

United States Patent [19]

Witler et al.

[11] Patent Number: 5,290,037

[45] Date of Patent: Mar. 1, 1994

[54] GOLFING APPARATUS

[76] Inventors: James L. Witler, 403 Pine St., Minturn, Colo. 81645; Douglas L. Spike, 799 Deer Blvd.; Douglas C. Talbot, 625 Stone Creek Dr., both of Eagle-Vail, Colo. 81620

[21] Appl. No.: 758,847

[22] Filed: Sep. 11, 1991

Related U.S. Application Data

[63] Continuation-in-part of Ser. No. 617,573, Nov. 26, 1990, Pat. No. 5,092,602.

[51] Int. Cl.[5] ..... A63B 69/36

[52] U.S. Cl. ..... 273/184 R

[58] Field of Search ..... 273/184 R, 184 A, 185 R, 273/185 A, 185 B, 183 R

[56] References Cited

U.S. PATENT DOCUMENTS 5,092,602 3/1992 Witler et al. ..... 273/184

*Primary Examiner*—William H. Grieb

[57] ABSTRACT

A golfing apparatus determines the carrying distance of a golf ball which has a golfer has struck and includes a speed measuring mechanism, either an acoustic trigger or an optical trigger, a correlator and a display. The speed measuring mechanism has a boresight disposed at angle in the range of zero degrees to twenty five degrees with respect to level ground so that it can be aimed at the struck golf ball while in flight. Either the acoustic trigger or the optical trigger is electrically coupled to the speed measuring mechanism and turns on the speed measuring mechanism in response to either the sound of the struck golf ball or the sight of the golf club striking the golf ball, respectively. The speed measuring mechanism measures the component of the speed of the golf ball which is parallel to the boresight. The correlator is electrically coupled to the speed measuring mechanism and correlates the measured component of the speed of the golf ball for each club with an empirically derived multiplier for use in determining the carry distance of the golf ball. The display is electrically coupled to the correlator and displays the carry distance of the golf ball so that the golfer can determine how far the golf ball which he has hit will carrying in flight.

2 Claims, 2 Drawing Sheets

Fig. 1.
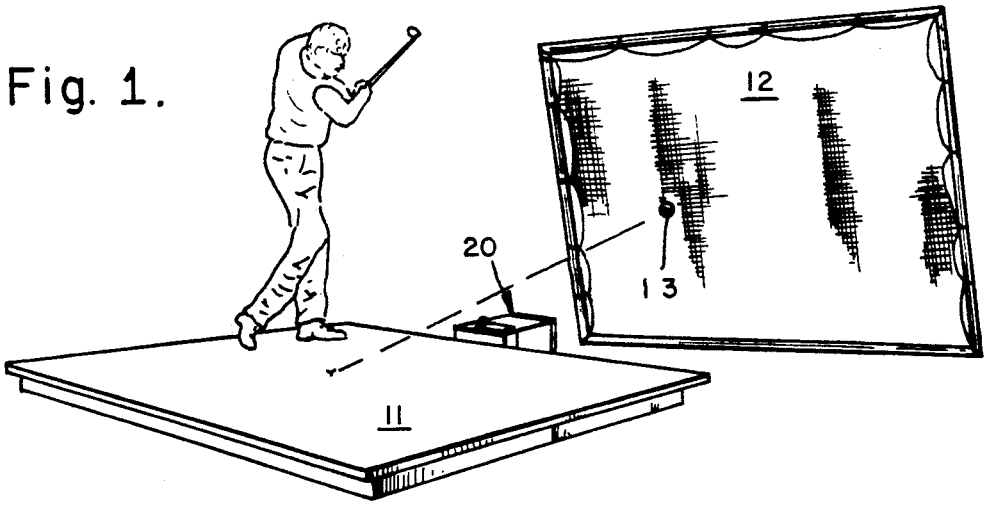
Fig. 2.
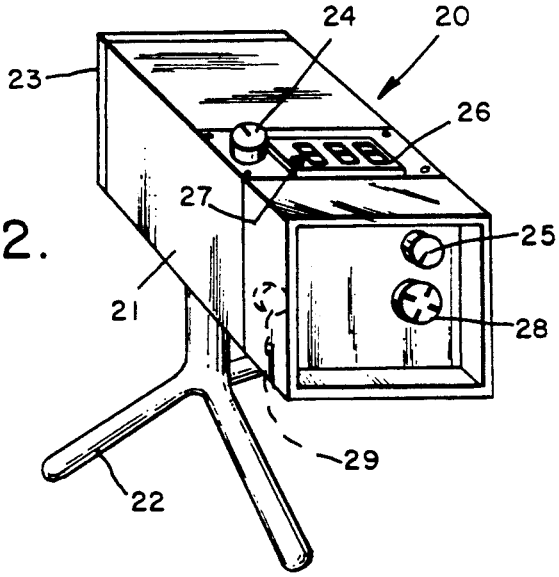
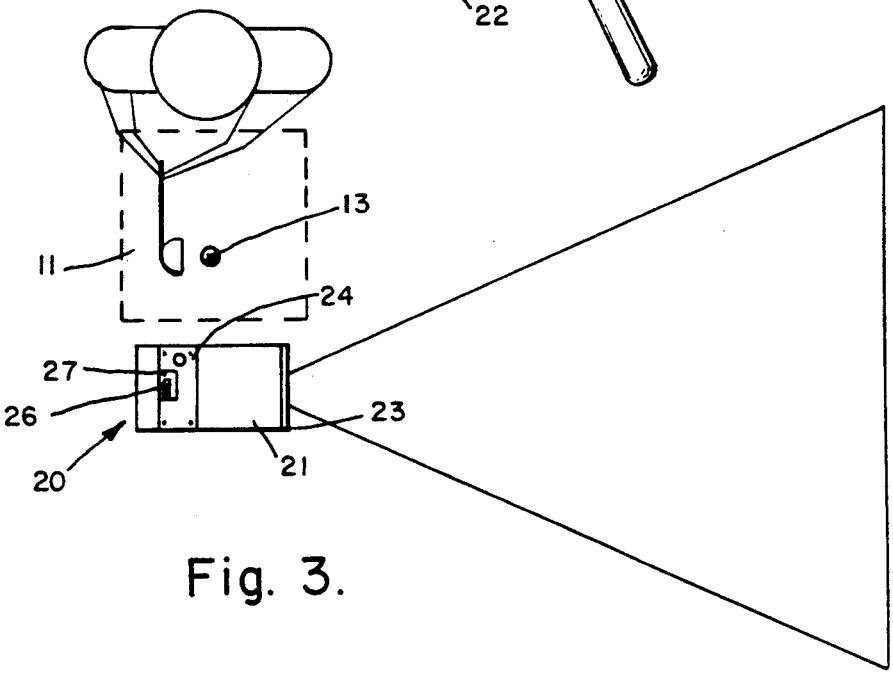
Fig. 3.

GOLFING APPARATUS

This application is a continuation-in-part of the application filed on Nov. 26, 1990 under Ser. No. 07/617,573, now U.S. Pat. No. 5,092,602, issued Mar. 3, 1992.

BACKGROUND OF THE INVENTION

1. Field of the Inventions

The present invention relates to a golfing apparatus for determining the carry distance of a golf ball in flight and more particularly to a golfing apparatus which incorporates a doppler radar unit, a correlating circuit and a club-selecting mechanism.

2. Description of the Prior Art

U.S. Pat. No. 4,858,922, entitled Method and Apparatus for Determining the Velocity and Path of Travel of a Ball, issued to Jerome Santavaci on Aug. 22, 1989, teaches two velocity sensing devices which are disposed on opposite sides of the proposed path of travel of a ball. The electromagnetic energy beams from two velocity sensing devices are directed at acute angles to the proposed path of travel. The two velocity sensing devices generate velocity signals which are averaged and converted to visible messages concerning the speed of the ball and its likely distance of travel had its flight not been interrupted.

U.S. Pat. No. 4,136,394, entitled Golf Yardage Indicator System, issued to Joseph Jones, Steven J. Pang and Roland L. Woodard, Jr. on Jan. 23, 1979, teaches a golf distance indicator system which provides a measurement of the distance between a golfer and the green which he is approaching. The system includes a base unit mounted at or near the pin on the green and a remote unit carried by the golfer. Upon command, the remote unit transmits a radio pulse to the base unit. The base unit immediately returns an acoustic or sonic signal, preferably an ultrasonic signal, in response to the received radio pulse. The remote unit includes internal logic for determining the distance from the base unit to the remote unit from the time interval between the transmission of the radio pulse and the reception of the ultrasonic signal based upon the speed of sound waves through air. The remote unit also receives input wind conditions and determines range and direction corrections to the actual distance based upon these wind conditions. From the wind corrected distance, the remote unit automatically selects the proper club for the next shot.

U.S. Pat. No. 4,184,156, entitled Doppler Radar Device for Measuring Speed of Moving Objects, issued to Viktor A. Petrovsky, Lev G. Gassanov, Sergei M. Belyaev, Lev A. Kochetov, Vitaly L. Kryzhanovsky, Andrei A. Palamarchuk, Rafail J. Timraleev, Viktor D. Ushakov and Vitaly Parfenjuk on Jan. 15, 1980, teaches a doppler radar device for measuring the speed of moving objects, which includes a casing with an antenna, a transmitter-receiver unit, a data-processing unit enclosed therein, control elements and a power cable. The casing is formed with an elongated tubular section of heat-conducting material, the antenna and units being successively arranged along the casing and rigidly interconnected to enable thermal contact there between and the casing. The outer periphery of the units is shaped to correspond to the inner surface of the casing. The doppler radar device may also be used as a portable means for measuring the speed of landing aircraft (speed monitoring by ground personnel), the approach and mooring speeds of ships, the speed of objects during sporting events involving the use of various vehicles, the speed of moving objects in industrial use and the speed of mud-laden torrents.

U.S. Pat. No. 3,187,329, entitled Apparatus for Vehicular Speed Measurements, issued to Bernard J. Midlock on Jun. 1, 1965, teaches a transmitter-receiving unit which is provided for mounting within a cylindrical member similar to a siren or a spotlight for attachment to an automobile; one end of the cylinder is closed by the casing and the other end is closed by a dielectric plastic polystyrene radome cover which has a curved lens shaped surface to provide a rigid surface which will withstand the air pressure when mounted on a moving vehicle. There are various mobile Doppler radar devices for measuring the speed of moving objects and they are well known in the prior art.

The Doppler radar device of U.S. Pat. No. 3,187,329 includes a transmitter-receiver unit and an antenna which are mounted on the outside of a vehicle and a mechanism for processing and displaying information, i.e. the signals bouncing off a target object, which are arranged inside the vehicle. This Doppler radar device is rather bulky and generally limits the field of its application. There are also portable Doppler radar devices for measuring the speed of moving objects such, for instance, as the speedgun which CMI, Inc. manufactures. This portable Doppler radar device includes a transmitter, a receiver with its mixer accepting a portion of transmitter output as a reference (heterodyne) voltage, a Doppler-frequency amplifier and an actuator (speed data processing and display unit), all functional units are enclosed in a comparatively small casing. Current is drawn from a vehicular power source through a cable. Such devices may also be used as self-contained units operating from adequate and compact power sources (batteries). For example, the speedgun is a gun contained within a heavy casing and comprising two longitudinally detachable halves of intricate shape (aluminum alloy casings). Lugs inside the casing are used for securing functionally independent units; a transmitter-receiver unit with a heavy horn antenna having a surface large enough to dissipate heat generated while the oscillator is in operation; an amplifier and signal-shaping unit complete with a voltage regulator; and a data-processing and display unit (actuator) employing a comparatively large printed-circuit board. Control elements are provided both on the inside and outside of the casing and also on the power cable (on-off switch). The functional units contained within the casing are attached independently (parallel arrangement), the interconnection thereof being for the most part electrical. The printed-circuit board mounting the data-processing unit is protected with an electrostatic shield. With this arrangement, gaps are provided between the functional units to enable convectional rejection of heat generated in large amounts while the emission oscillator and voltage regulator are in operation. With such an arrangement, however, there is quite a number of limiting factors such as: failure to meet compactness requirements (modern trend towards portable small-size devices); failure to fully meet sealing requirements essential in using the devices under adverse weather conditions (rain, fog, snow, elevated humidity); failure to withstand vibration on moving objects such, for example, as civil ships; and failure to meet dynamic strength requirements essential, for example, in using the aforesaid device both as speed meter and a traffic controller's baton.

A narrow beam of radio waves is generated by the circuit and is transmitted by a directional antenna in a direction at a slight angle or parallel to the direction of a particular vehicle question. These radio waves are reflected back to the sending unit by the vehicle in question to vary the frequency of the reflected wave in proportion to the speed of the vehicle. The frequency of this latter signal may be amplified and converted by a frequency measuring circuit into miles per hour or other convenient units.

High frequency waves of approximately 10525 megacycles are radiated through the radome cover. A small quantity of such transmitted waves are reflected from the cover back to the receiver to serve as a local oscillator for mixing in a crystal mixer of the receiver. The Doppler modified reflected waves are reflected to the receiver from a vehicle and vary in frequency in dependence upon the speed of the vehicle. The waves beat in a crystal mixer of the receiver to provide a Doppler difference alternating frequency output depending upon the vehicular speed. The Doppler wave will hereinafter be referred to as an audio wave although it will be appreciated that it may be a sub-audio tone.

At a transmitted frequency of 10525 megacycles, the beat frequency Doppler signal will be 31.3 cycles per second for every mile per hour of vehicle speed. A detection of a vehicle travelling at 1, 10 or 100 miles per hour will produce audio signals of 31.3, 313 or 3130 cycles per second, respectively. The use of a different transmitted frequency will provide a different range of audio or sub-audio frequencies, and the detection of vehicles such as trains or airplanes as opposed to automobiles may make it desirable to utilize a different transmission frequency or a different audio band. However, such details are well known and are not a part of this invention. The audio wave is amplified in a group of transistor amplifiers which are stabilized against amplitude, temperature and voltage variations which are inherent in the environmental operation of the apparatus. The stabilized audio signal on line is fed into a normally blocked gated driver transistor which prohibits passage of any audio signal except when gated by audio signals of a desired magnitude. Such gating assures that undesired weak signals will not pass to the output. Doppler signals from vehicles which are not within the desired range of the apparatus will be of insufficient amplitude to gate the driver. Only Doppler signals of sufficient amplitude give reliable readings are permitted to pass through the driver. Weak signals from a swaying tree, or the like, are also controlled. The stabilized audio signal on line feed a gate which is controllably biased so that only audio signals of a predetermined magnitude will open the gate. The magnitude of the audio signal is determined by a gain control in the amplifier. The gate includes a transistor amplifier and rectifier connected to line for controlling a transistor multivibrator to control a clamp. The clamp is normally operated to prevent speed signals from passing through the gated driver. Operation of the gate circuit removes this clamping to permit signals to pass through driver. This gating operation exists for the duration of the input signal. Receipt of a sufficient desired amplitude of audio signal, as determined by the gain control operates the transistor amplifier-receiver and triggers multivibrator which operates the clamp and opens the gated driver by reducing the bias on line to allow the audio signal to be amplified and supplied to an amplitude clipper. The amplitude clipper is a zener diode which clips one half of the audio wave in one conductive direction and clips the other half of the wave at a predetermine voltage determined by the characteristics of the zener diode. The output of the clipper on line is then a series of substantially square wave pulses of constant amplitude having a frequency depending upon the speed of the detected vehicle. This series of pulses then passes through a frequency responsive network which provides a current output in proportion to the frequency of the input signals. This current output then controls a meter and/or recorder to provide a visual and/or graphic indication of speed. A cylindrical casing is provided to simulate a searching light or vehicle handlamp. A handle is connected to the casing for handling the apparatus while also serving as a support member and as an enclosure for the klystron oscillator. An opening is provided in the handle for providing leads for input connections to the klystron and output connections from the crystal mixer. Within the casing are individual transmitting and receiving antennas which essentially include two modified pill box antennas connecting wave guide members and a common sectoral horn. Pill box antennas are parabolic antennas which are symmetrically cut on both sides of their center point and then closed within two parallel plates to provide a high gain antenna having a highly directive beam. Such a cut parabolic or cylindrical reflector is a plate with the top portion serving as a reflector for received signals while the bottom portion serves as a reflector for transmitted signals. Three parallel plates serve to enclose the parabolic reflectors into transmitting and receiving modified pill box antennas for directing energy to or from the reflectors. The klystron oscillator and crystal rectifier assemblies are mounted directly upon the plates in contrast with conventional practice of having both of these elements at a remote location. This connection eliminates the need for coupling high frequency energy over long leads both to and from the antenna. Another advantage of mounting the klystron directly on the plate is that a relatively simple connection may be made to feed the antenna as will appear below. The klystron is a type VA-204 reflex manufactured by "Varian Associates" and is controllable in frequency by variation of the repeller voltage. The lower part of this tube has terminal pins for connection to heater and other voltage sources. The high frequency output voltage radiates directly from the top of this tube without connecting leads.

GB Patent No. 2 110545A, entitled Apparatus for Monitoring the Way in which Games Projectile is Struck, issued to Mervyn Beverly Hill on Jun. 22, 1983, teaches an apparatus which monitors the way in which a golf ball is struck. The apparatus includes either a very short range radar or a high speed video which detects the golf ball and a projector which provides a visual display of the golf ball as it is propelled. The apparatus has lateral boundary walls which diverge away from the tee and each of which has an impact absorbing covering such as netting, as does the end walls which includes a screen, the netting being in front of the screen, as considered by the player. The floor is sloped towards the player to provide a gravity collection arrangement whereby the golf balls once struck roll back towards the tee. The tee is on a raised part of the floor. The apparatus includes a slide projector for projecting an image of a fairway on the screen though a back projection system. Either the radar or the video projector is arranged behind the player in the line of flight so that the golf ball is detected and monitored in its flight, and the video projector projects the flight of the golf ball onto the screen so that the signal picked up by the very short range radar or video projector is projected onto the screen for the player to see. When the very short range radar device is used, it can detect the path and speed of the golf ball over the distance travelled from the tee to a point where the golf ball is captured by the absorbing netting, or material at end wall. Since the degree and direction of rotation about the vertical axis effects the amount of "draw" or "fade" the small amount of horizontal curvature of the short flight can be measured rather than trying to count or detect the degree of rotation. The speed of flight is derived either from the time of travel from the tee to back net either by employing electro/mechanical switches at two spaced-apart points or by the golf ball breaking two vertical light beam slits or by acoustics switch at the point of contact relating to the golf ball breaking a light beam at a suitable distance from the tee location. At the time of playback the speed information is also projected onto the screen.

U.S. Pat. No. 4,673,183, entitled Golf Playing Field with Ball Detecting Radar Units, issued to Francis B. Trahan on Jun. 6, 1987, teaches a golf playing arrangement which includes a fairway, a tee area at one end of the fairway, a plurality of radar ground surveillance units located on the fairway at successively greater distance from the tee area, a central processing unit, a video display terminal and a putting green adjacent the tee area. Each of the ground surveillance units detects golf balls moving on the ground in a predetermined circular area containing the unit. The central processing unit calculates and the computer terminal visually displays the distance of the unit furthest from the tee area which detects a golf ball moving therethrough, and the sum of a succession of such distances. This arrangement permits a golfer to play a golf-like game without the need to follow a golf ball from tee to green. In this golf playing arrangement a golfer is permitted to play a condensed game of golf in which they are required to walk only short distance between a tee and a green. Other prior art condensed golf games have permitted a player to simulate repeatedly hitting and following after a golf ball until the ball lands on the green as in a conventional game of golf, by hitting successive golf balls from a tee area, estimating the distance traveled by the golf ball each time it is hit, until the total distance which the golf ball has been hit equals a preselected distance to a theoretical green. In this prior art condensed game, the player would then walk over to an adjacent green to "putt out". Such a game is, for example, disclosed in U.S. Pat. No. 2,003,074, issued to B. E. Gage on Feb. 1, 1933. These art condensed games have a number of disadvantages. Since golf balls are often hit long distances such as from 100 to 100 yards, it can be quite difficult to see the final resting place of the golf ball and then estimate the distance it has travelled, even if distance markers are provided. It is also necessary to perform manual calculations of the accumulated distances successive golf balls are hit to reach the "green". Furthermore, if a number of persons are competing with each other, disagreements can arise as to these distances and the number of strokes which have been taken on a particular hole.

U.S. Pat. No. 4,086,630, entitled Computer Type Golf Game having a Visible Fairway Display, issued to Maxmilian Richard Speiser on Apr. 2, 1978, teaches a computer type golf game which includes a spot image golf ball simulator, and means for changing a scene display upon a screen on which the spot image golf ball simulator is projected in accordance with theoretical attained distance achieved with each successive play. The scene display is projected optically from a slide magazine type projector, in which certain slides are disposed in slide retaining recesses in the slide magazine having encoded information corresponding to specific data related to the fairway of an individual hole, whereby when the first side pertaining to that hole is positioned for projection, this information is transferred to program a computer, whereby sides to projection position. The slides corresponding to certain fixed increments may be eliminated, in order to keep the total number of slides displaying the entire golf course within the capacity of the slide projector magazine. A mechanism is included for adding to the displayed indication of distance to the pin the additional distance made necessary by driving a golf ball laterally with respect to the principal axis of the fairway when the attained yardage has already approached a predetermined distance from the pin. Scene display pictures correspond to views seen from points in field in the direction toward the pin, permitting a forward, side and reverse approach to the pin, where necessary. The embodiment provides not only for a visual representation of the approximate lay of the golf ball, but numeric displays showing information relative to how far the golfer has progressed toward the pin with each hole, and other displays indicating a lay to the left or right of the fairway as well. A mechanism is provided for conditioning signals received from the golf ball intercepting net whereby spurious signals are eliminated.

U.S. Pat. No. 4,898,388, entitled Apparatus and Method for Determining Projectile Impact Locations, issued to Bryce P. Beard, III, James W. Kluttz and Edgar P. Roberts, Jr. on Feb. 6, 1990, teaches an apparatus which determines projectile impact locations and, in a specific application, to determining a golfer's performance in using a particular club, such as a specific iron. The apparatus has an array of a plurality of vibration sensors distributed in a predetermined pattern in a target area, each of which generates a signal indicative of the sensing of vibration, a processor connected for receiving sensor signals generated and for processing received sensor signals for determining a location of projectile impact relative to the locations of sensors in the target area and for generating an electrical location signal, and a display connected with the processor for receiving the location signal and for displaying to an observer a representation of the location of projectile impact in the target area.

U.S. Pat. Nos. 4,440,482 and 4,490,814, entitled Sonic Autofocus Camera Having Variable Sonic Beamwidth, issued to Edwin K. Shenk on Apr. 3, 1984 and Dec. 25, 1984, teaches a sonic ranging system that includes an ultrasonic, capacitance-type transducer having a multiple segment backplate whose sonic beam angle is automatically correlated to the field-of-view angle of the image forming lens.

U.S. Pat. No. 4,447,149, entitled Pulsed Laser Radar Apparatus, issued to Stephen Marcus and Theodore M. Quist on May 8, 1984, teaches a pulsed laser radar apparatus utilizing a Q-switched laser unit to generate laser pulse signals including a low intensity trailing tail. The trailing tail is utilized to provide a local oscillator signal that is combined with the target return signal prior to detection in a heterodyne detector unit.

U.S. Pat. No. 4,437,032, entitled Sensor for Distance Measurement by Ultrasound, issued to Egon Gelhard on Mar. 13, 1984, teaches a sensor for performing the distance measuring in accordance with the ultrasound-echo principle, in particular for determining and indicating approaching distances between vehicles and obstacles in close range with an ultrasound transmitter and receiving converter for emitting the ultrasound signals and for receiving the ultrasound signals reflected by the obstacles. The converter consists of an insulated-type transformer with piezo-ceramic resonator disposed thereon, characterized in that dampening material for preventing the energy rich ultrasound emission or reception is provided on the inside of the membrane of the insulator-type transformer on two horizontally opposite disposed circular segments.

U.S. Pat. No. 4,464,738, entitled Sonar Distance Sensing Apparatus, issued to Stanislaw B. Czajkowski on Aug. 7, 1984, teaches a distance sensing apparatus which is provided in the form of a case housing electronic equipment including a piezoelectric transducer for radiating pulsed sonic or ultrasonic signals along a measurement path through a sound horn which creates a narrow beam. Reflected signals received back through the horn are received by the transducer and converted into electric measurement signals. A time measurement device is providing for determining the time lapse between radiation of a pulse and receipt of a reflected signal so as to provide a distance signal which will be representative of the path distance between the apparatus and the surface which will trigger a display to give a distance reading. An important feature of the apparatus is that the electronic circuitry will include an amplifier which will increase the amplification of the electrical signals carried by a reflected pulse at a function of time lapsed from the radiation of a measurement signal pulse so as to compensate for the attenuation of the received signal.

U.S. Pat. No. 4,281,404, entitled Depth Finding Apparatus, issued to Ray E. Morrow, Jr. and Richard W. Woodson on Jul. 28, 1981, teaches a hand held, self-contained depth finding device which is immersible into water for transmitting and receiving sonic impulses in the direction the device is aimed. The device includes a hand grip carrying a battery cartridge and an external trigger for operating a power switch within the waterproof interior. A liquid crystal display registers the measured depth in feet.

U.S. Pat. No. 4,914,734, entitled Intensity Area Correlation Addition to Terrain Radiometric Area Correlation, issued to Robert J. Love and Richard I. Campbell on Apr. 3, 1990, teaches a system which combines intensity area correlation for use with terrain height radar and infrared emissivity systems to give a simultaneous three-mode map matching navigation system. The infrared system senses passive terrain emissions while the height finding radar measures the time between transmission of a radar signal to the ground and receipt of a radar return. The intensity correlator uses the radar returns to sense changes in the reflection coefficient of the terrain. Map matching all three modes simultaneously provides an accurate, highly jam resistant position determination for navigation update.

U.S. Pat. No. 4,805,015, entitled Airborne Stereoscopic Imaging System, issued to J. Copeland on Feb. 2, 1989, teaches an imaging system which includes widely-spaced sensors on an airborne vehicle providing a baseline distance of from about five to about 65 meters between the sensors. The sensors view an object in adjacent air space at distances of from about 0.3 to 20 kilometers. The sensors may be video cameras or radar, sonar infrared or laser transponders. Two separate images of the object are viewed by the spaced sensors and signals representing each image are transmitted to a stereo display so that a pilot/observer in the aircraft has increased depth perception of the object.

U.S. Pat. No. 4,914,639, entitled Sonar Doppler System with a Digital Adaptive Filter, issued to Earl R. Lind and Francis C. Jarvis on Apr. 3, 1990, teaches a doppler sonar speed measuring system incorporating a digital adaptive filter responsive to the difference in newly received raw speed data and previously received speed data to determine the amount and sign of change of the previously received data. The allowable amount of change increases to a maximum allowed value if the sign of the change remains the same on successive received data as under acceleration conditions and reduces to a minimum value when the sign changes on successive received data.

U.S. Pat. No. 4,935,742, entitled Automatic Radar Generator, issued to Jonathan Marin on Jun. 19, 1990, teaches an autonomous radar transmitting system transmits radar signals which simulate the presence of a police-manned radar station. A controller runs pseudo-randomizing programs to select the width of a radar pulse transmitted as well as the time lapse between subsequent pulses. The radar output of the system is therefore sufficiently random to prevent a detecting circuit from identifying it in the time it takes for a motorist with a radar detector to reach the radar source. This system is battery powered and a photovoltaic panel is provided to recharge the battery, thus giving the system a long lifespan. Also provided is an infrared detector through which infrared signals may be input to the controller.

U.S. Pat. No. 4,913,546, entitled Range Finder, issued to Shinji Nagaoka, Koji Sato and Yuji Nakajima on Apr. 3, 1990, teaches a range finder which projects an infrared light beam to an object and the light beam reflected from the object is detected by a split photosensor. The photosensor is made up of two photodiodes connected in opposite polarity relationship so that a differential photocurrent produced by the diode pair is amplified. The reflected light beam is tracked so that the photosensor provides a zero output, and the distance to the object is determined from the time needed to detect the zero photosensor output.

U.S. Pat. No. 4,831,604, entitled Ultrasonic Range Finding, issued to James A. McKnight and Leslie M. Barrett on May 16, 1989, teaches a range finding equipment which includes a manipulator carries a pair of send-receive ultrasonic transducers arranged back to back so as to direct ultrasound signals towards reflectors associated with the structural components to be monitored. The transducers are pulsed with signals derived by gating a few cycles of a sustained reference signal of sine wave form and the resulting echo signals can be used to provide transit time and phase displacement information from which the spacing between the reflectors can be derived with a high degree of precision.

U.S. Pat. No. 4,953,141, entitled Sonic Distance-measuring Device, issued to Joel S. Novak and Natan E. Parsons on Aug. 28, 1990, teaches a sonic distance-measuring device for use in air which includes three transducers in an array of transducers, which are driven in a predetermined phase relationship so as to achieve a beam width that is substantially less than that which can be achieved by any of the transducers individually. To enable the user to aim the device effectively, a lamp is provided to shine along the sonic beam and thus help the user direct the beam at a desired target. To conserve energy and increase the ability to distinguish the light beam from ambient light, the lamp is pulsed rather than driven steadily.

U.S. Pat. No. 4,675,854, entitled Sonic or Ultrasonic Distance Measuring Device, issued to Jurgen Lau on Jun. 23, 1987, teaches a sonic or ultrasonic distance measuring device which includes an electroacoustic transducer which operates alternately as transmission transducer for the transmission of sonic or ultrasonic pulses and as reception transducer for the reception of the reflected echo pulses. Connected to the transducer is a signal processing circuit which includes an amplifier with controllable gain and a threshold value discriminator. A gain control circuit controls the gain of the amplifier during a predetermined period after the start of each transmission pulse in accordance with a stored function which is fixed in accordance with the dying-down behavior of the transducer so that the electrical signals originating from the dying-down of the transducer after amplification are smaller than the threshold value of the threshold value discriminator but are as close as possible to the threshold value. As a result the evaluation of echo pulses which occur during the dying-down of the transducer is possible.

U.S. Pat. No. 4,858,203, entitled Omni-directional distance measurement system, issued to Per K. Hansen on Aug. 15, 1989, teaches an omni-directional distance measurement system which transmits and receives ultrasound waves using as many as four transmitting-receiving transducers having specially shaped beam-widths. Through the use of four such ultrasonic transducers, the system may be set up to obtain any beam-width from 5 degrees up to 360 degrees in both the horizontal and vertical planes. The omni-directional distance measurement system is able to detect the distance and direction to up to four objects in a prescribed work area at any one time and may also detect the speed of any one of the objects if desired.

SUMMARY OF THE INVENTION

In view of the foregoing factors and conditions which are characteristic of the prior art it is the primary object of the present invention to provide a golfing apparatus which incorporates a doppler radar unit, a correlating circuit and a selecting mechanism and which measures the carry distance of a golf ball.

It is another object of the present invention to provide a golfing apparatus which a golfer may use either at an outdoor driving range or an indoor driving range either with a net or without a net.

It is still another object of the present invention to provide a compact golf game which closely simulates a true game of golf without requiring each player to follow his golf ball to a distant green and provides a clear indication of the distance traveled by the golf ball.

It is yet another object of the present invention to provide such a compact golf game which is suitably located on a portion of a golf driving range.

It is yet still another object of the present invention to provide a compact golf game in which a radar detector and a display serve to inform the player of the distance each of his struck golf ball has traveled.

In accordance with the present invention an embodiment of a golfing apparatus for determining the carry distance of a golf ball in flight is described. The golfing apparatus includes a doppler radar unit, a measuring cone with a boresight, a correlating circuit and a display which is electrically coupled to the correlating circuit. The doppler radar unit has a housing, a transmitter and receiver unit and a counter. The transmitter and receiver unit is disposed in the housing and transmits electromagnetic energy towards the golf ball and produces a plurality of pulses which is the Doppler shift of the electromagnetic energy in order to measure the component of the speed of the golf ball which is parallel to the boresight. The transmitter and receiver unit is aimed at the golf ball while in flight so that the boresight of the transmitter and receiver unit is disposed at angle in the range of zero degrees to twenty five degrees with respect to level ground. The counter is electrically coupled to the transmitter and receiver unit and counts the plurality of pulses over a preselected period of time. The golf ball passes through the measuring cone and the doppler radar unit measures speed of the golf ball therein. The correlating circuit is electrically coupled to the doppler radar unit and correlates the measured component of the speed of the golf ball for each club with an empirically derived multiplier for use in determining the carry distance of the golf ball. The display displays the carry distance so that the golfer can determine how far the struck golf ball will carry.

The correlating circuit includes a selecting mechanism which selects the preselected period of time so that the counter counts out directly the number of yards which the struck golf ball will carry.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a schematic drawing of a golfer who is standing on a hitting platform after having struck a golf ball with his club so that the golf ball carries into a net and who is using a golfing apparatus which has been made in accordance with the principles of the present invention to measure the distance which the golf ball will carry.

FIG. 2 is a perspective view of the golfing apparatus of FIG. 1.

FIG. 3 is a top plan view of the golfing apparatus of FIG. 1 in use with a schematic drawing of the golfer of FIG. 1 addressing the ball.

DESCRIPTION OF THE PREFERRED EMBODIMENT

Figure 4:
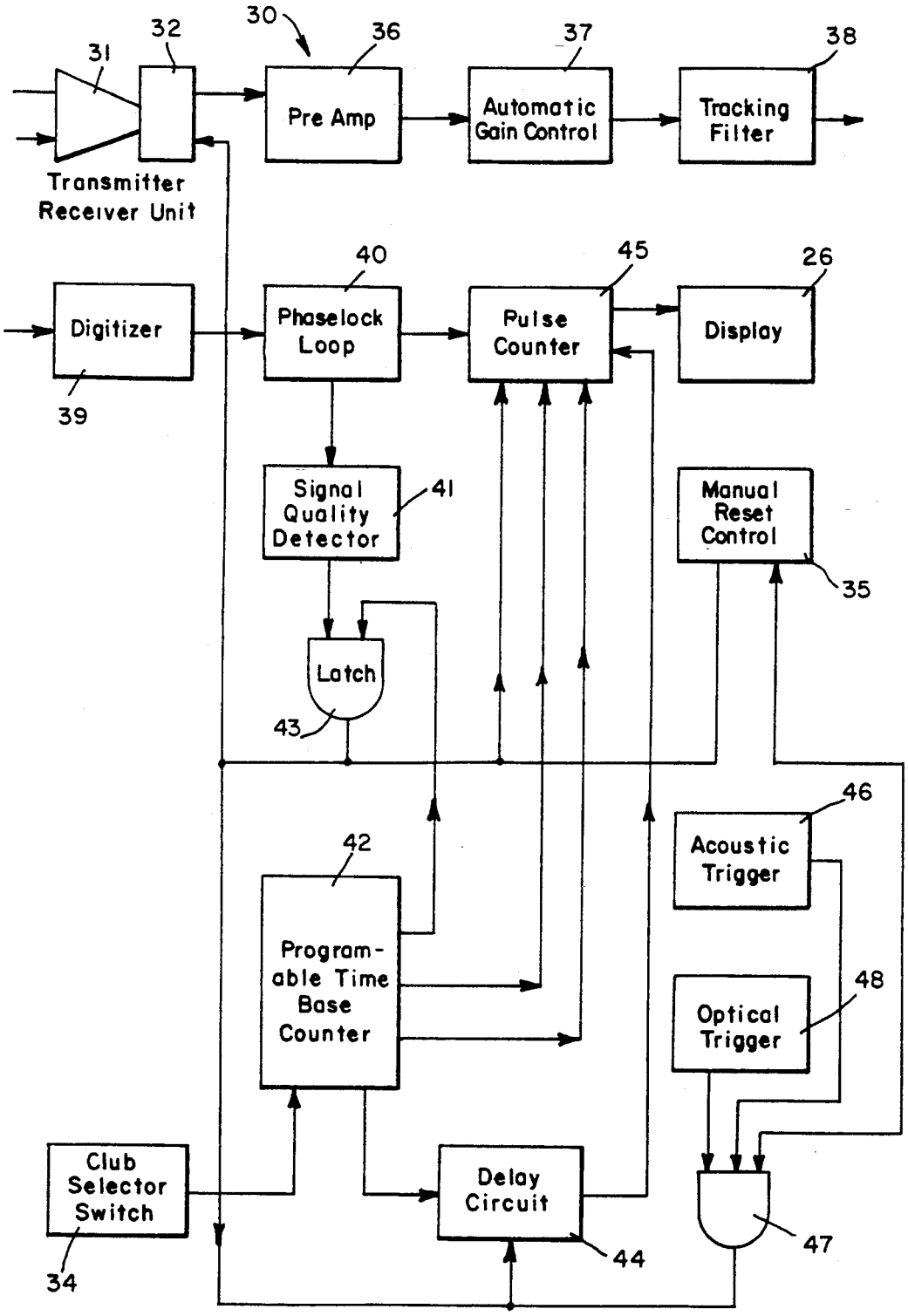
FIG. 4 is a circuit diagram of the golfing apparatus of FIG. 1.

In order to best understand the present invention it is necessary to refer to the following description of its preferred embodiment in conjunction with the accompanying drawing. Referring to FIG. 1 in conjunction with FIG. 2 and FIG. 3 a golfer is standing on a hitting platform 11 after having struck a golf ball 13 with his club so that the golf ball 13 carries into a net 12. A reference plane is horizontal to the flat surface of the hitting platform 11. The golfer uses a golfing apparatus 20 in order to measure either the distance which the golf ball 13 will carry in flight or the total distance which the golf ball 13 will carry in flight and roll.

Referring to FIG. 2 the golfing apparatus 20 includes a housing 21, a stand 22 on which the housing 21 is mounted and a radome plastic cover 23 for an antenna which directs electromagnetic energy towards the flight path of the struck golf ball 13 in order to determine a Doppler shift relative to its speed. The radome plastic cover 23 should be pointed along the intended direction of flight. The golfing apparatus 20 also includes a club selector switch 24, a timer reset 25, a display 26 which is mechanically coupled to the housing 21, a low battery indicator light 27 which is mechanically coupled to the housing 21, a remote connector 28 which is mechanically coupled to the housing 21 and a battery charge-up jack 29 which is mechanically coupled to the housing 21. The club selector switch 24 is a switch with which the golfer selects a desired club (D=driver, 2W=2 wood, 3W=3 wood, 1=1 iron, 2=2 iron, . . . . and PW=pitching wedge). The timer reset 25 is a manually adjustable control which increases (clockwise) or decreases (counterclockwise) the reset time. The adjustment range is from 1 to 60 seconds. The liquid crystal display (LCD) 26 has three digits each of which is formed from a combination of seven segments. The low battery indicator light 27 is activated when the internal battery voltage of the golfing apparatus 20 drops below that required for operation. The batteries can be recharged with the trickle charger to restore full charge through the battery charge-up jack 29. The remote connector 28 is a five pin connector which is used to attach the golfing apparatus 20 to a remote display for use during golf-driving contests. The battery charge-up jack 29 is a receptacle for attachment of a separate AC power pack to charge the internal batteries or provide power for remote power supply operation. A three position toggle switch is used to turn "on" the golfing apparatus 20. "Off" is the middle position with "On" towards the right or left. Power is supplied when the radar displays "000". The golfing apparatus 20 further includes a correlating circuit 30, an antenna 31, a transmitter and receiver unit 32 and the display 26. The transmitter and receiver unit 32 includes a doppler radar unit, a measuring cone with a boresight and a counter 45. The doppler radar unit has a housing, a transmitter and receiver unit. The antenna 31 directs a rectangular beam of electromagnetic energy from the transmitter and receiver unit 32 along a boresight. The transmitter and receiver unit 3 is disposed in the housing 21 and transmits electromagnetic energy towards the golf ball 13 in order to generate a plurality of pulses which is the Doppler shift of the electromagnetic energy in order to measure the component of the speed of the golf ball 13 which is parallel to the boresight. The transmitter and receiver unit 32 is aimed at the golf ball 13 while in flight so that the boresight of the transmitter and receiver unit 32 is disposed at angle in the range of zero degrees to twenty five degrees with respect to level ground. The counter 45 is electrically coupled to the transmitter and receiver unit 32 and counts the plurality of pulses over a preselected period of time. The golf ball 13 passes through the measuring cone and the doppler radar unit measures speed of the golf ball 13 therein. The correlating circuit 30 is electrically coupled to the doppler radar unit and correlates the measured component of the speed of the golf ball 13 for each club with an empirically derived multiplier for use in determining the carry distance of the golf ball 13. The display 26 displays the carry distance so that the golfer can determine how far the struck golf ball 13 will carry. The correlating circuit 30 includes a selecting mechanism which selects the preselected period of time so that the counter 45 counts out directly the number of yards which the struck golf ball 13 will carry.

The golfing apparatus 20 is a one-piece instrument and makes use of the speed and the trajectory, which is a function of the launch angle of the struck golf ball 13, to predict the carry distance. The boresight of the rectangular beam of electromagnetic energy, which travels outwardly, is aimed towards either the driving range or the net 12 at an angle in the range of zero to twenty five degrees relative to the reference plane. The golfing apparatus 20 takes into account three factors in determining the carry distance of the struck golf ball 13. The first factor is the speed of the struck golf ball 13 along the boresight of the rectangular beam of electromagnetic energy. The second factor is the trajectory of the struck golf ball 13. The third factor is a weighing factor which has been obtained empirically for each club. The component of the speed which is parallel to the boresight is related to the first and second factors of speed and trajectory and is determined by the product of the cosine of the angle with respect to the boresight and the actual speed of the struck golf ball. The third factor for each club is obtained empirically by dividing the component of speed which is parallel to the boresight into the actual carry distance. The ideal trajectory for a struck golf ball 13, which has been hit with a driver, is at an angle of ten degrees relative to the reference plane. If the struck golf ball 13 travels either above or below the boresight it will not travel as far as the struck golf ball 13 which travels along the boresight. Since maximum distance is desired only with the driver the ideal trajectory for a golf ball 13, which is hit with an iron is at an angle of greater than ten degrees relative to the reference plane.

The golfing apparatus 20, when positioned correctly, determines ball speed by being pointed upward in the range of zero to twenty five degrees, preferable ten degrees, so that its front edge is 1.5 inches higher than its rear edge. If the stand 22, or a tripod, is not available the golfer can place one of his golf balls 13 under the front edge of the golfing apparatus 20 in order to position it correctly. The golf ball 13 may be placed within a 10×20 inch area of the golfing apparatus 20. If the golf ball 13 is not placed in this area the golfing apparatus 20 might not give accurate results and/or it might "miss" golf balls 13 by not displaying a carry distance. The golf ball 13 should not be placed behind the golfing apparatus 20, as either the golf ball 13 or the golf club might hit it.

Still referring to FIG. 2 once the golfing apparatus 20 is positioned and the golf ball 13 is properly placed, the golfer selects the club he wishes to use and sets the club selector switch 24 in the appropriate position so that the golfing apparatus 20 is ready to use. The golfer simply hits the golf ball 13 and reads the carry distance on the display 26. The golfer uses the reset timer 25 to adjust the time for which the reading on the display 26 is held. When hitting golf balls 13 into a net a time delay of 5 to 10 seconds is appropriate. When hitting golf balls 13 on a driving range or any other appropriate area, the time delay should be set so that the golfer can watch the golf ball 13 land and roll before resetting to "000". The golfer may need to make several trial and error shots before he can determine the correct reset time. The golfing apparatus 20 makes its carry distance determination in as little as 10 feet. Many factors influence the flight of the golf ball before, during and after the golfing apparatus 20 has made its prediction. The golfing apparatus 20 can "see" the effect of those factors which occur before and during determination, however it cannot "see" the effect of those factors which happen after it has made its determination. Those factors which the golfing apparatus 20 can "see" include club head speed variations, certain swing path variations, certain ball spin variations, where the golf ball 13 was struck relative to the "sweet spot" and ball compression differences. Those factors which the golfing apparatus 20 cannot "see" include the topped shot, a severe hook, a severe slice, certain dimple pattern variations and the effects of wind. Shots which are affected by the latter factors will be incorrectly displayed by the golfing apparatus 20. Normally this should not cause alarm as golf is a game where the desired objective is consistency and the golfer knows when the golf ball is topped or severely hooked or severely sliced. The elevation also has an effect on carry distance. One model of the golfing apparatus 20 may be operated at elevations from slightly below sea level to 3000 feet; other models of the golfing apparatus 20 may be operated at higher elevations above 3000 feet. The golfing apparatus 20 will operate for a minimum of 4 hours on a full charge. The actual operation time depends on how often the golfer resets the golfing apparatus 20 to "000". The golfing apparatus 20 draws the most current when waiting for the golf ball 13 to be struck. The battery charger will charge the batteries in sixteen hours. The golfing apparatus 20 displays no reading if multiple targets are detected. If too much turf is taken with the swing the golfing apparatus 20 might not display a reading. The golfer should try taking less turf or try teeing the golf ball.

Referring to FIG. 4 the correlating circuit 30 includes a master clock 33, a club selector switch circuit 34 and a manual reset control circuit 35 and either an acoustic piezoelectric trigger 46 or an optical trigger 48. The correlating circuit 30 also includes a pre-amplifier circuit 36, an automatic gain control circuit 37, a tracking filter circuit 38 and a digitizer 39. The pre-amplifier circuit 36 is electrically coupled to the transmitter and receiver unit 32. The automatic gain control circuit 37 is electrically coupled to the pre-amplifier circuit 36. The tracking filter circuit 38 is electrically coupled to the automatic gain control circuit 37. The digitizer 39 is electrically coupled to the tracking filter circuit 38. The transmitter and receiver unit 32 is disposed in the housing 21 and transmits electromagnetic energy towards the golf ball 13 in order to produce a plurality of pulses which is the Doppler shift of the electromagnetic energy. The correlating circuit 30 further includes a phaselock loop 40, a signal quality detector 41, a programmable time base counter 42, a latch 43, a delay circuit 44, the AND gate 47 which electrically couples the output of either the acoustic piezoelectric trigger 46 or the optical trigger with the output of the manual reset control 35 and a pulse counter 45 the output of which is electrically coupled to the display 26. The input of the phaselock loop 40 is electrically coupled to the output of the digitizer 39 and its output is electrically coupled to the input of the counter 45. The input of the signal quality detector 41 is electrically coupled to the output of the phaselock loop 40 and its output is electrically coupled to the first input of the latch 43. The second input of the latch 43 is electrically coupled to the first output of the programmable time base counter 42 and its output is electrically coupled to the pulse counter 45. Either the acoustic piezoelectric trigger 46 or the optical trigger is mechanically and electrically coupled to the housing 21. Either the acoustic piezoelectric trigger 46 or an optical trigger is an available option. The output of the master clock 33 is electrically coupled to the first input of the programmable time base counter 42. The output of the club selector switch 34 is electrically coupled to the second input of the programmable time base counter 42. The second output of the programmable time base counter 42 is electrically coupled to the first input of the delay circuit 44.

The correlating circuit 30 is electrically coupled to the transmitter and receiver unit 32 and counts the plurality of pulses over a preselected period of time. The golf ball 13 passes through the beam of electromagnetic energy. The doppler radar unit measures the speed of the golf ball 13 therein. The correlating circuit 30 is electrically coupled to the doppler radar unit and correlates the measured speed of the golf ball 13 with a carry distance. The display 26 is electrically coupled to the correlating circuit 30 and displays the carry distance so that the golfer can determine how far the golf ball 13 which he has hit will carry. The correlating circuit 30 includes a club selector switch 34 which selects the preselected period of time so that the pulse counter 45 counts out directly the number of yards which the struck golf ball 13 will carry. The phaselock loop 40 multiplies each pulse from the digitizer by a factor of eight in order to shorten the necessary time period to obtain a reading directly in yards on the display 26. The golfing apparatus 20 will predict the carry distance of a struck golf ball 13 on the fly; by changing the program of the programmable time base counter 42 the golfing apparatus can display the total of the carry distance of a golf ball 13 in flight and its roll distance thereafter. The frequency of the plurality of pulses, is the Doppler shift of the electromagnetic energy, relates directly to the speed of the component of the speed which is parallel to the boresight. A preselected period of time for each club has been set by the golfer's using the club selector switch 24 in order to directly relate the total number of pulses over the preselected period to the distance in yards which the struck golf ball 13 carries. The programmable time base counter 42 counts the plurality of pulses over the preselected period of time. Operation with either the optionally available acoustic piezoelectric trigger 46 or the optionally available optical trigger is as follows: upon power up the correlating circuits 30 wait for a signal from either the acoustic piezoelectric trigger 46 or the optical trigger that a golf ball 13 will shortly be present. Upon receiving the signal from either the acoustic piezoelectric trigger 46 or the optical trigger the correlating circuits 30 are activated. When a struck golf ball 13 is displayed and frozen on the display 26. At which time the correlating circuits will wait for another signal from either the acoustic piezoelectric trigger 46 or the optical trigger.

Alastair Cochran and John Stobbs have written a book, entitled *The Search for the Perfect Swing*, which J. B. Lippcott Company published in 1968. Cochran and Stobbs state that the carry distance can be predicted according to the following formula: Carry distance=(-velocity) (1.5)−103, where velocity is in feet/second for any reasonably struck golf ball with a driver; other clubs will have not only a different multiplier but also a different subtraction factor. This formula is a non linear function. Another feature of the golfing apparatus 20 is that it will have a club selector switch to adjust the internal circuitry to allow any club in a golf bag with the exception of a putter to be used. For example, if the golfer wants to use his 5 iron, he simply sets the pointer of the club selector switch 24 to "5 iron" and the electronics will calculate the carry distance. The golfer can use any club in his golf bag to determine exactly how far he can hit a golf ball with that club even in the dead of winter while hitting golf balls into a net. There are other uses for the golfing apparatus 20 including golf pro shops and specifically shops to demonstrate the difference between clubs and even golf balls, as rental unit at driving ranges, in long drive contests, and as a training and teaching aid. Since the golfing apparatus 20 can predict carry distance in as little as 10 feet the golfing apparatus 20 uses also include hitting golf balls 13 into a net. Golfers will no longer have spend money on golf balls 13 at the driving range. Golfers in the snow belt can continue to hit golf balls 13 indoors all winter and determine whether the practice is resulting in improvement. The sensor is automatically activated upon power up, and is under the control of an adjustable, panel mounted timer. The time adjusted is from (1) [5] to 60 seconds. When a struck golf ball 13 is detected, the sensor will turn off and the distance will be displayed and frozen on the display. Upon time out the sensor will turn on and wait for another golf ball to be struck.

The golfing apparatus 20 does not use club head speed because club head speed for the average golfer relates only indirectly to carry distance. The more important factor is how well the golf ball 13 was struck. The extreme example is the whiff—the club head speed sensor gives an indication of distance, but the golf ball 13 goes nowhere. In this situation the golfing apparatus 20 will display the correct reading: "000" yards. In testing done at the local driving range with a professional golfer the accuracy is within plus or minus five percent. The golfing apparatus 20 is the only device which uses these two pieces of information to determine carry distance. There are other systems which are available to give an indication of ball speed, but each of them requires an intricate setup and the cost of each is prohibitive i.e., greater than $10,000. The golfing apparatus 20 sells for less than $1,000. These systems are photocell based and measure elapsed time over a fixed distance. These systems cannot sense the launch angle so they cannot predict carry distance. The golfing apparatus 20 makes the ball speed determination and the subsequent distance prediction in as little as 10 feet of ball flight. The golfing apparatus 20 can predict the carry distance while hitting into a net. The golfing apparatus 20 is available to the golfer without problems of obtaining a license from the Federal Communication Commission. Most radar systems are required to obtain such a license although this licensing requirement has been generally overlooked. The Speedball contest in amusement parks and the JUGS gun used by baseball teams to clock pitching speeds are prime examples.

In another embodiment the speed measuring device includes a range finder which U.S. Pat. No. 4,913,546 teaches, which projects an infrared light beam to an object and the light beam reflected from the object is detected by a split photosensor. The photosensor is made up of two photodiodes connected in opposite polarity relationship so that a differential photocurrent produced by the diode pair is amplified. The reflected light beam is tracked so that the photosensor provides a zero output, and the distance to the object is determined from the time needed to detect the zero photosensor output. The range finder instanteously determines the location of the struck golf ball in flight at each of a plurality of predetermined time intervals in order to measure the distance which the struck golf ball has moved away from the housing 21 at each predetermined time interval and provide distance measurements thereof. A microprocessor processes the distance measurements in order to determine the speed of the struck golf ball. The microprocessor may also be either a microcomputer or a CRAY supercomputer.

In still another embodiment the speed measuring device includes a sonic ranging system, which U.S. Pat. Nos. 4,440,482 and 4,490,814 teach, which includes an ultrasonic, capacitance-type transducer in the housing 21. The sonic ranging system instanteously determines the location of the struck golf ball in flight at each of a plurality of predetermined time intervals in order to measure the distance which the struck golf ball has moved away from the housing 21 at each predetermined time interval and provide distance measurements thereof. A microprocessor processes the distance measurements in order to determine the speed of the struck golf ball.

From the foregoing it can be seen that a golfing apparatus for determining the carry distance of a golf ball has been described. It should be noted that the sketches are not drawn to scale and that distance of and between the figures are not to be considered significant.

What is claimed is:

1. A golfing apparatus for determining the carry distance of a golf ball which has a golfer has struck, said golfing apparatus comprising:

a. a speed measuring mechanism having a boresight disposed at angle in the range of zero degrees to twenty five degrees with respect to level ground so that it can be aimed at the struck golf ball while in flight wherein said speed measuring mechanism measures the component of the speed of the golf ball which is parallel to said boresight;

b. a correlator electrically coupled to said speed measuring mechanism, said correlator correlates said measured component of the speed of the golf ball for each club with an empirically derived multiplier for use in determining the carry distance of the golf ball;

c. a display electrically coupled to said correlating means whereby said display displays the carry distance of the golf ball so that the golfer can determine how far the golf ball which he has hit will carry in flight; and d. an acoustic trigger coupled to said speed measuring mechanism, said acoustic trigger turns on said speed measuring mechanism in response to the sound of the struck golf ball.

2. A golfing apparatus for determining the carry distance of a golf ball which has a golfer has struck, said golfing apparatus comprising:

a. a speed measuring mechanism having a boresight disposed at angle in the range of zero degrees to twenty five degrees with respect to level ground so that it can be aimed at the struck golf ball while in flight wherein said speed measuring mechanism measures the component of the speed of the golf ball which is parallel to said boresight;

b. a correlator electrically coupled to said speed measuring mechanism, said correlator correlates said measured component of the speed of the golf ball for each club with an empirically derived multiplier for use in determining the carry distance of the golf ball;

c. a display electrically coupled to said correlating means whereby said display displays the carry distance of the golf ball so that the golfer can determine how far the golf ball which he has hit will carry in flight; and d. an optical trigger coupled to said speed measuring mechanism, said optical trigger turns on said speed measuring mechanism in response to the sight of the golf club striking the golf ball.

* * * * *